US008900098B2

(12) United States Patent
Egan

(10) Patent No.: US 8,900,098 B2
(45) Date of Patent: Dec. 2, 2014

(54) EXERCISE DEVICE

(76) Inventor: Fiona Mary Egan, Roscommon (IE)

( * ) Notice: Subject to any disclaimer, the term of this patent is extended or adjusted under 35 U.S.C. 154(b) by 0 days.

(21) Appl. No.: 14/124,573

(22) PCT Filed: Jun. 8, 2012

(86) PCT No.: PCT/EP2012/060933

§ 371 (c)(1),
(2), (4) Date: Dec. 6, 2013

(87) PCT Pub. No.: WO2012/168454

PCT Pub. Date: Dec. 13, 2012

(65) Prior Publication Data

US 2014/0106935 A1 Apr. 17, 2014

(30) Foreign Application Priority Data

Jun. 8, 2011 (GB) ..... 1109577.5

(51) Int. Cl.
*A63B 24/00* (2006.01)

(52) U.S. Cl.
USPC ..... 482/4; 482/1; 482/8; 128/202.12

(58) Field of Classification Search
USPC ..... 482/1–9, 900–902; 601/6–11; 128/202.12
See application file for complete search history.

(56) References Cited

U.S. PATENT DOCUMENTS

| | | | | |
|---|---|---|---|---|
| 7,189,193 | B2 * | 3/2007 | Egger | 482/57 |
| 7,591,795 | B2 * | 9/2009 | Whalen et al. | 601/11 |
| 8,464,716 | B2 * | 6/2013 | Kuehne et al. | 128/205.26 |
| 2002/0025889 | A1 | 2/2002 | Egger | |

FOREIGN PATENT DOCUMENTS

| | | | |
|---|---|---|---|
| DE | 201 00 339 | U1 | 3/2001 |
| DE | 10 2004 031548 | A1 | 2/2006 |
| DE | 203 21 337 | U1 | 11/2006 |
| PL | 64 980 | Y1 | 6/2010 |

OTHER PUBLICATIONS

International Preliminary Report on Patentability (IPRP) for International Application No. PCT/EP2012/060933, Dec. 27, 2013, 6 pages.
International Search Report for International Application No. PCT/EP2012/060933 mailed Nov. 15, 2012.

* cited by examiner

*Primary Examiner* — Glenn Richman
(74) *Attorney, Agent, or Firm* — Brian J. Colandreo; Jeffrey T. Placker; Holland & Knight LLP

(57) ABSTRACT

This invention relates to an exercise device and more particularly to an exercise device of the type that allows the user of the exercise device to exercise with part of their body in a negative pressure environment. These devices are becoming increasingly popular however the known devices are prone to frequent failure. The present invention provides a construction of exercise device that reduces the incidences of failure caused by failure of the electronics panel. The electronics panel being mounted in a separate dedicated enclosure internal the chamber with the negative pressure environment, the interior of the dedicated enclosure is isolated from the negative pressure conditions and atmosphere in the remainder of the chamber. The exercise device will be more reliable and cost effective to run. Furthermore, the construction of the present invention permits easier access to the interior of the casing for maintenance when maintenance is required.

20 Claims, 19 Drawing Sheets

EXERCISE DEVICE

RELATED APPLICATIONS

The subject application is a U.S. National Stage application of International Application No. PCT/EP2012/060933, which claims the priority of United Kingdom National Application No.: 1109577.5, filed on 8 Jun. 2011, the contents of which are herein incorporated by reference in its entirety.

INTRODUCTION

This invention relates to an exercise device and more particularly to an exercise device of the type that allows the user of the exercise device to exercise with part of their body in a negative pressure environment.

Exercise devices that allow the user of the exercise device to exercise with part of their body in a negative pressure environment have become increasingly popular. It has been found that by exercising with part of their body in a negative pressure environment, for example that part of their body below the torso, the quality and intensity of the workout can be improved significantly. This leads to a reduction in the amount of time required to exercise for the same amount of physical health benefit or alternatively will result in an increased physical health benefit obtained from the exercise if the workout time is not reduced. Various other health benefits have been observed including but not limited to a reduction in cellulite and an improvement in the appearance of varicose veins.

There are numerous exercise devices that allow the user of the exercise device to exercise with part of their body in a negative pressure environment available on the market today. PCT Patent Publication Nos. WO2009/051750 and WO2009/051765, both in the name of Alterg Inc., describe various embodiments of exercise devices that allow the user of the exercise device to exercise with part of their body in a negative pressure environment. U.S. Pat. No. 5,133,339 in the name of Whalen et al and Polish utility models PL64980Y1, PL64905Y1 and PL64906Y1, all in the name of VacuFit Sp. z o. o., show various embodiments of exercise devices that allow the user of the exercise device to exercise with part of their body in a negative pressure environment.

As of the filing date of the application from which the present application claims priority, other similar exercise devices were available through the companies Body Space (Registered Trade Mark, ®) (www.spacesun.eu), Vacuwell® (www.vacuwell.com), Vacustep® (www.vacustep.com) and Vacuspace® (www.vacuspace.pl).

Although there are numerous benefits to this type of exercise device, there are problems with many of the known exercise devices. Unfortunately, many of the known exercise devices are relatively unreliable in operation and are prone to breaking down. This results in a significant amount of downtime and represents a significant cost to the proprietor of the exercise device. When the exercise device is not operational, it cannot be used to generate revenue for the proprietor and furthermore a repair person must be paid to repair the exercise device. This lack of reliability also leads to mistrust in the machines thereby presenting a barrier to more widespread uptake and popularity of the exercise devices.

One of the main culprits of downtime is the electronics components in the exercise device failing. The Applicant of the present invention has found that due to the fact that the exercise devices require a sealed chamber to allow the negative pressure conditions to be created, the temperature in the interior of the chamber will often be relatively high, much higher than the normal ambient temperature at which the electronic components usually operate. This problem is further exacerbated by the fact that infra-red bulbs are also often used within the vacuum chamber as part of a complementary therapy, thereby further increasing the temperature within the chamber and increasing the likelihood of the electronics components failing.

WO2010/132550, in the name of Kuehne, describes an exercise device in which the electronics unit appears to be mounted towards the front of the device but is external the chamber. US2002/0025889, in the name of Egger, appears to provide an electronics unit mounted rearward of and external to the chamber in a separate casing. DE20100339, in the name of Braun, appears to disclose an exercise device in which the electronics panel is located in a separate unit external and rearward of the chamber. It is a goal of the invention to provide an exercise device with an electronics panel that is mounted inside the chamber rather than outside the chamber as this will potentially provide a more compact exercise device with a potentially lower footprint and also will provide a more aesthetically pleasing exercise device. It is an object of the invention to provide an exercise device with such a construction but without the reliability problems that arise from such a construction.

It is an object of the present invention to provide an exercise device of the type that allows the user of the exercise device to exercise with part of their body in a negative pressure environment that overcomes the above-mentioned problem in whole or in part.

It is a further object of the present invention to provide an exercise device that offers the consumer a useful choice.

STATEMENTS OF INVENTION

According to the invention there is provided an exercise device comprising a casing defining an exercise chamber having an opening to receive the torso of an individual during use of the exercise device, a door in the casing to provide access to and from the exercise chamber, an exercise unit located in the exercise chamber, a vacuum pump operable to create a negative pressure in the exercise chamber and control means for controlling the exercise unit and the vacuum pump, the control means comprising an electronics panel which is associated with the vacuum pump and is mounted internal the chamber, in which the electronics panel is mounted in a separate dedicated enclosure internal the chamber, the interior of the dedicated enclosure is isolated from the negative pressure conditions and atmosphere in the remainder of the chamber, and in which there is further provided a ventilation arrangement for the dedicated enclosure and the electronics panel to cool the electronics panel during operation of the exercise device, the ventilation arrangement comprising a fluid passageway between the interior of the dedicated enclosure and the atmosphere external the casing, the fluid passageway comprising at least a vent hole in the casing in communication with the atmosphere external the casing for allowing entry of ambient temperature air inwards from external the casing through the vent hole and along the fluid passageway to circulate across the electronics panel in the dedicated enclosure before being exhausted back out of the dedicated enclosure through the vent hole.

By having such an arrangement, the electronics panel will still be mounted internal the casing, thereby providing a compact device with the minimum footprint possible, but will not be subjected to the harsh environment normally experienced within the casing. Instead, the electronics panel will be housed in its own separate enclosure and that enclosure will be provided with a dedicated ventilation arrangement to cool the electronic components in the enclosure. This arrangement will prevent the electronics components from overheating and failing prematurely. Instead, the electronics components will be allowed to operate within or at least closer to their specified operating range, thereby obviating the likelihood of the electronic components failing on a regular basis. As a result, there is provided a significantly more reliable exercise device that will minimise revenue loss due to machine failure and repair expenses.

In one embodiment of the invention there is provided an exercise device in which the ventilation arrangement further comprises a fan mounted in the dedicated enclosure for drawing ambient temperature air inwards from external the casing through the vent hole and along the fluid passageway and thereafter circulating the ambient air across the electronics panel in the dedicated enclosure before exhausting the ambient air back out of the dedicated enclosure through the vent hole.

In one embodiment of the invention there is provided an exercise device in which the fluid passageway further comprises a length of conduit, one end of which is in communication with the interior of the dedicated enclosure and the other end of which is in communication with the vent hole. By providing a conduit, the enclosure does not have to be formed integrally with the remainder of the casing and instead a simpler configuration of enclosure may be provided.

In one embodiment of the invention there is provided an exercise device in which the enclosure is located adjacent the front of the chamber. In the prior art devices, it was not practical to mount the electronics panel adjacent the front of the chamber. This was due to the fact that the electronics panel was one of the most unreliable components often needing repair and the front of the chamber was typically the most inaccessible area of the chamber unless inspection hatches were provided, which in themselves are undesirable. Therefore, it is counterintuitive to mount the enclosure inside the chamber in this location. However, due to the improved reliability of the exercise device due to the present arrangement, the enclosure and the electronics panel may be mounted in this location taking advantage of available space in this area of the exercise device. This will permit a more compact exercise device overall to be produced.

In one embodiment of the invention there is provided an exercise device in which the enclosure is located adjacent the top of the chamber. Again, it is counterintuitive to mount the enclosure inside the chamber in this location as this is perhaps the hottest portion of the chamber. However, the present arrangement allows for the efficient cooling of the electronics module thereby facilitating the placement of the electronics panel in this location. This will also allow for a more compact device overall to be produced.

In one embodiment of the invention there is provided an exercise device in which the dedicated enclosure is a basin shaped enclosure having an open mouth and a circumferentially extending lip surrounding the open mouth for sealable engagement with the casing. This is seen as a particularly useful configuration as the enclosure may be mounted below the drinks tray thereby allowing placement of the electronics panel in and access to the electronics panel through the open mouth.

In one embodiment of the invention there is provided an exercise device in which the dedicated enclosure is constructed from one of a plastics and a fiberglass material. The plastics or fiberglass material will further act to insulate the electronics panel from the heat inside the chamber.

In one embodiment of the invention there is provided an exercise device in which the control means comprises a second electronics panel which is associated with the exercise unit and is mounted internal the casing, in which the second electronics panel is mounted in a second separate dedicated enclosure internal the casing, the interior of the second enclosure is isolated from the negative pressure conditions in the remainder of the chamber and in which there is further provided a second ventilation arrangement for the second enclosure and the second electronics panel to cool the second electronics panel during operation of the exercise device, the second ventilation arrangement comprising a second fluid passageway between the interior of the second enclosure and the atmosphere external the casing, the second fluid passageway comprising at least a second vent hole in the casing in communication with the atmosphere external the casing, the second ventilation arrangement further comprising a fan mounted in the second enclosure for drawing ambient temperature air inwards from external the casing through the second vent hole and along the second fluid passageway and thereafter circulating the ambient air across the second electronics panel in the second enclosure before exhausting the ambient air back out of the second enclosure through the second vent hole.

It has been found that the electronic components for the exercise unit are of lesser but still not inconsequential risk of breaking down and it is highly advantageous to also locate this electronics panel in a separate dedicated enclosure internal the casing. Again, ventilation is provided to this enclosure to cool the second electronics panel during operation. Although this solution may be seen to add to the manufacturing complexity, the manufacturing cost due to additional components and the running costs due to the additional power using devices, it is believed that these costs will be far outweighed by the benefit of less failures of the exercise device.

In one embodiment of the invention there is provided an exercise device in which the second fluid passageway further comprises a second length of conduit, one end of which is in communication with the interior of the second enclosure and the other end of which is in communication with the second vent hole.

In one embodiment of the invention there is provided an exercise device in which the second enclosure is located adjacent the front of the chamber.

In one embodiment of the invention there is provided an exercise device in which the second enclosure is located adjacent the bottom of the chamber.

In one embodiment of the invention there is provided an exercise device in which the second enclosure is formed as part of the exercise unit. This is seen as a particularly simple construction of exercise device to provide.

In one embodiment of the invention there is provided an exercise device in which a motor of the exercise unit is also mounted in the second enclosure. This is seen as advantageous as the motor can be cooled effectively and will have less tendency to fail and further the heating effects of the motor within the chamber can be reduced by dissipating the heat from the motor in this way. This will have the benefit of providing a more comfortable experience for the user of the exercise device.

In one embodiment of the invention there is provided an exercise device in which the exercise unit is mounted on a base plate and in which the casing is hingedly mounted about the base plate and pivotable to and from a lowered position sealably engaging the base plate and a raised position inclined relative to and substantially free of the base plate. This is seen as a useful implementation as it will be far easier to access the electronic panels in particular if there should be a failure of the electronic panels.

In one embodiment of the invention there is provided an exercise device in which there is further provided a strut internal the casing to releasably maintain the casing in a raised position.

In one embodiment of the invention there is provided an exercise device in which the casing is hingedly mounted about a hinge located adjacent the forwardmost point on the base plate.

DETAILED DESCRIPTION OF THE INVENTION

The invention will now be more clearly understood from the following description of some embodiments thereof given by way of example only with reference to the accompanying drawings, in which.

Figure 1:
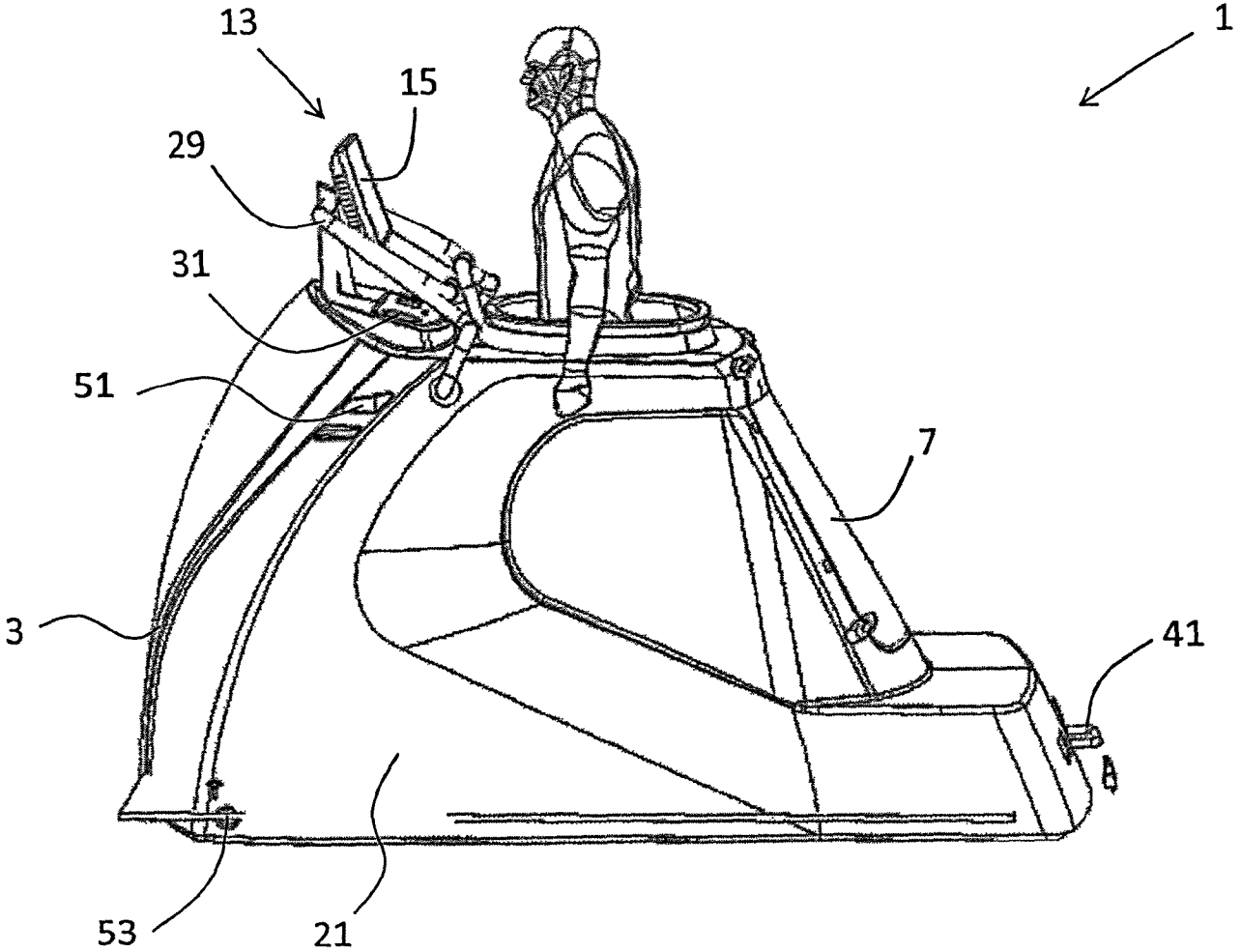
FIG. 1 is a perspective view of an exercise device according to the invention.

Referring to FIGS. 1 to 14 inclusive, there is shown an exercise device, indicated generally by the reference numeral 1, comprising a casing 3 defining an exercise chamber 5. A door 7 provides access to and from the exercise chamber. The exercise device 1 further comprises an exercise unit 9, in this case a treadmill, located in the exercise chamber, and a vacuum pump 11 operable to create a negative pressure in the exercise chamber 5. There is further provided a control means 13 for controlling the exercise unit 9 and the vacuum pump 11. The control means 13 in turn comprises a control panel 15, an electronics panel 17 mounted in a separate enclosure 19 and a second electronics panel (not shown) mounted in a second separate enclosure 20 internal the exercise unit 9 (see FIG. 14).

The exercise device 1 is provided in a modular construction format having a plurality of components connectable together to form the exercise device 1. For example, referring specifically to FIG. 13, it can be seen that the casing 3 effectively comprises a three part construction including a left hand side panel 21, a right hand side panel 23 and the door 7 that may be connected together on site to construct the exercise device. The exercise device 1 comprises a base plate 25 upon which the exercise unit 9 is mounted. The base plate 25 has a peripheral lip 27 extending around the entire periphery of the base plate which forms an air tight seal with the casing side panels 21, 23 when the components are connected together.

In transit, the exercise device will be provided in three or more pieces, one of which being the left hand side panel 21, another of which being the right hand side panel 23 and a third of which being the base plate 25 with the exercise unit 9 connected thereto. The door 7, the control panel 15, the electronics panel 17, a user handle 29 and a drinks tray 31 could be provided individually or some/all of these components could be provided already affixed to one of the side panels 21, 23. Once the exercise device 1 arrives at the premises where it is to be installed, all of the pieces 7, 9, 15, 17, 21, 23, 25, 29 and 31 can be brought to the room where the machine is to be located, unpacked from their packaging and then constructed together on site.

Figure 11:
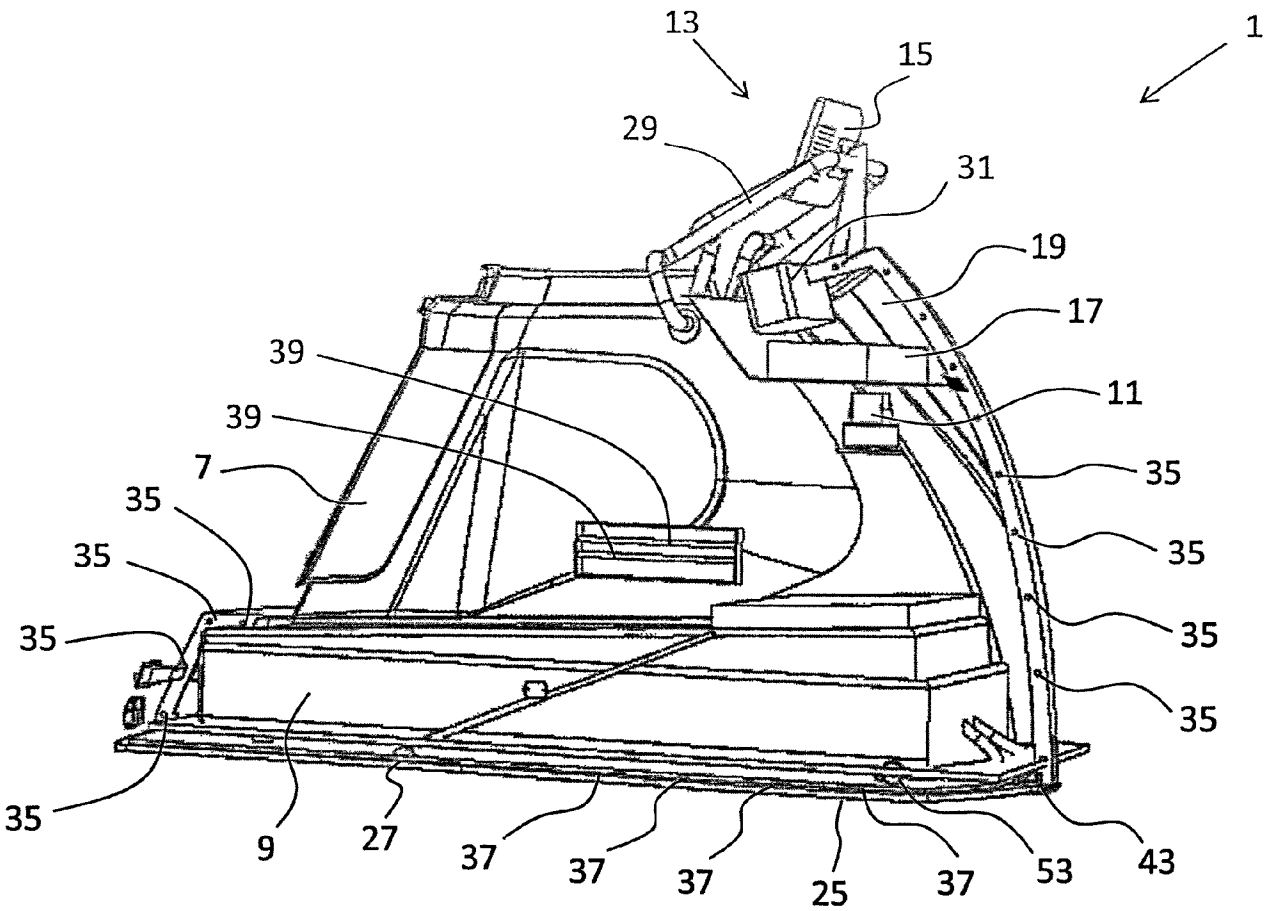
FIG. 11 is a right hand side perspective view of the exercise device with a casing panel removed.
Figure 12:
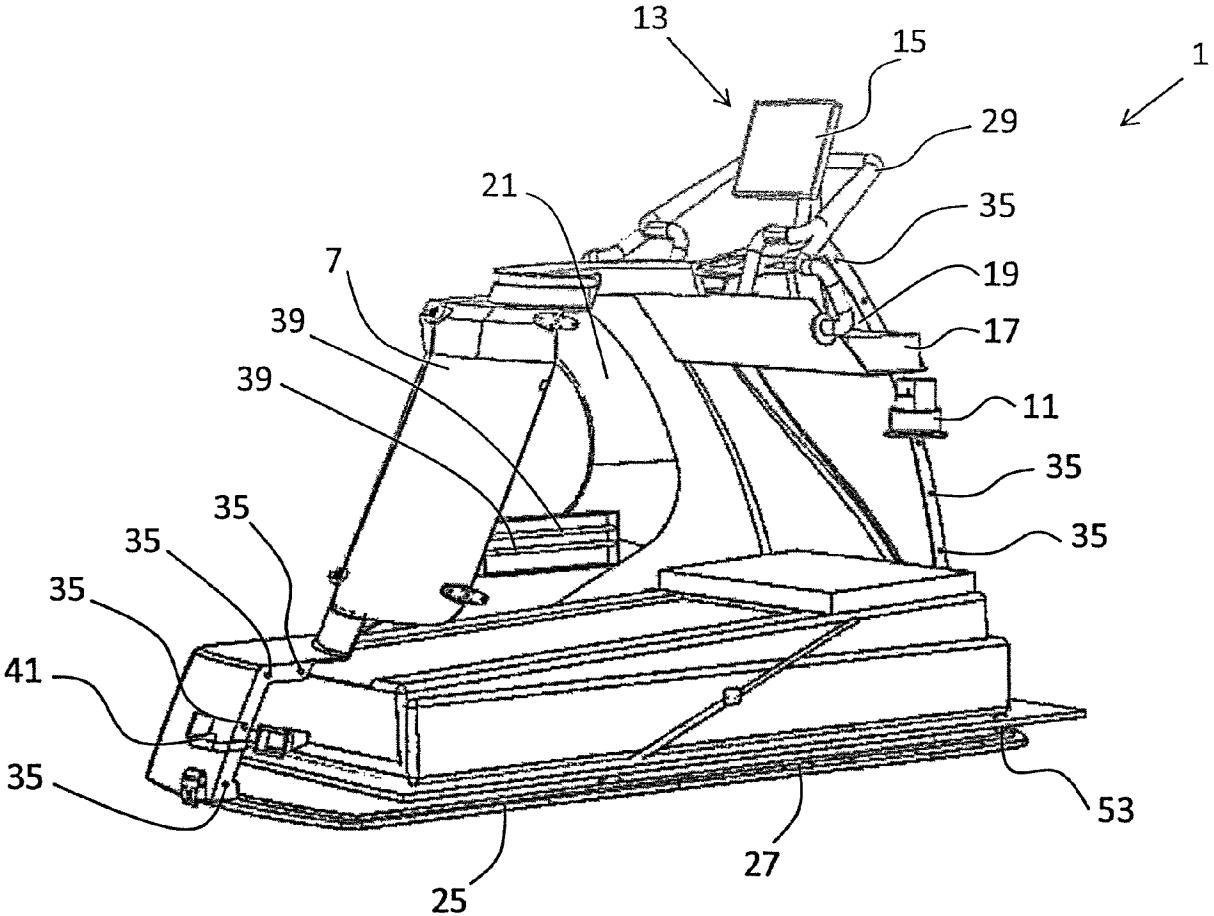
FIG. 12 is a rear perspective view of the exercise device shown in FIG. 11.
Figure 13:
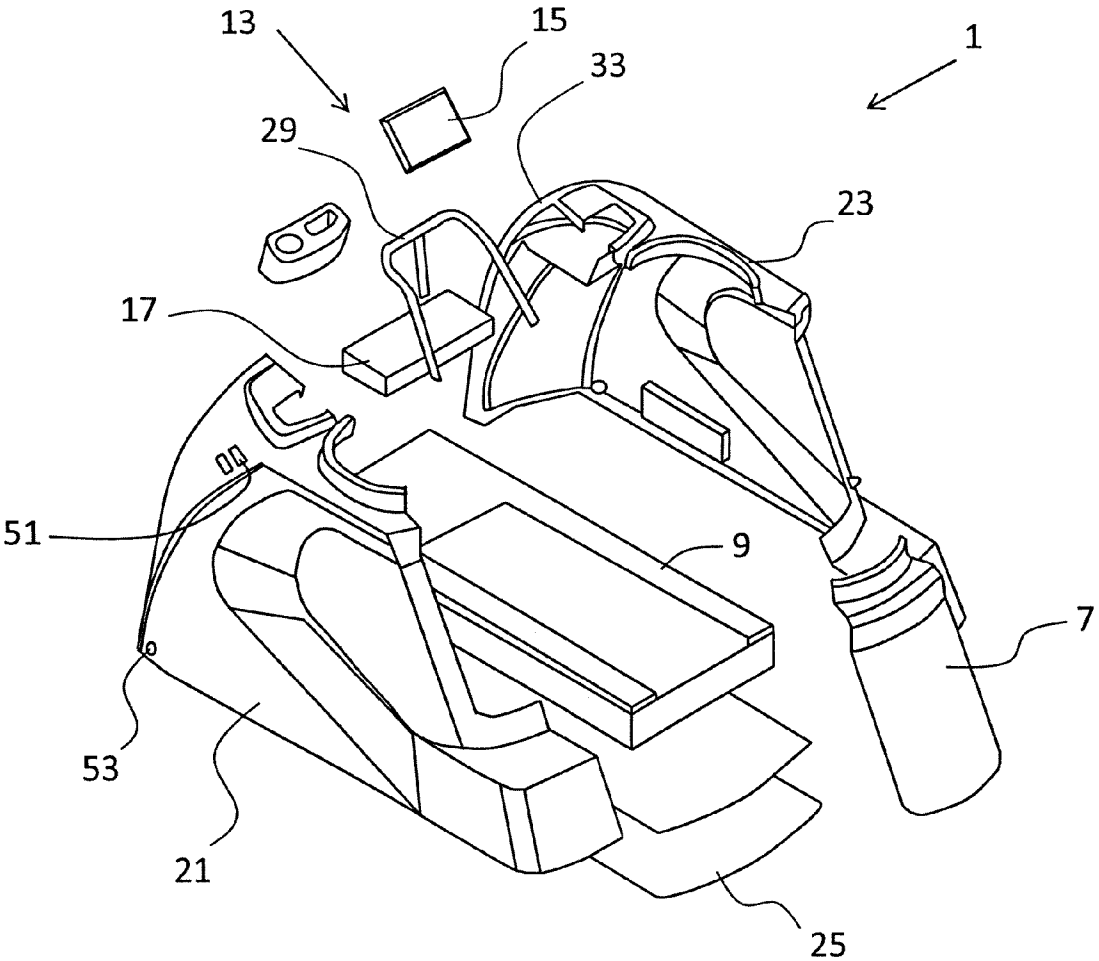
FIG. 13 is an exploded view of the exercise device according to the invention.

The connection members between the side panel 21 and the side panel 23 are of a relatively simple construction to allow fast and efficient construction of the exercise device on site. Right hand side panel 23 has a plurality of male members, in this case studs 33 (as best illustrated in FIGS. 3 to 8 inclusive) that are received in complementary female members, in this case recesses 35, in the left hand side panel 21 (as best illustrated in FIGS. 11 and 12). The studs 33 form a push fit in the recesses 35 and there will preferably be provided a seal, for example a rubber seal between the two side panels 21, 23 to form an air tight seal between the two side panels 21, 23.

The base plate 25 has a plurality of recesses 37 spaced about the peripheral lip 27 for reception of studs (not shown) on the underside of the side panels 21, 23. Again, a rubber seal (not shown) will preferably be provided between the side panels 21, 23 and the peripheral lip 27 to provide an air tight seal therebetween. It is envisaged that the studs on the underside of the side panels 21, 23 will form a relatively loose fit in the recesses 37 to allow relative movement therebetween.

In one embodiment, the studs 33 will each have an enlarged head portion (not shown) that is received in an enlarged cavity (not shown) in the recess 35. Either the enlarged heads or the entrance to the enlarged cavity will preferably be constructed from a resilient material to allow the studs "click" into place and to allow entry of the enlarged head into the enlarged cavity but prevent easy withdrawal of the enlarged head from the enlarged cavity. This will help to securely locate the studs 33 in the recesses 35. Alternatively, a screw thread may be provided on one or more of the studs 33 for engagement of a complementary screw thread on the recess 35. Furthermore, other securing means such as but not limited to an over-centre clasp could be used to bring the two side panels 21, 23 into close contact and a fixed relationship with respect to each other.

There is further provided a plurality of infra-red bulbs 39 mounted on the interior of the casing 3 on each of the side panels 21, 23. The is also provided a handle 41 that may be used to raise and lower the casing 3 as will be described in greater detail below with reference to FIGS. 15 to 18.

Figure 2:
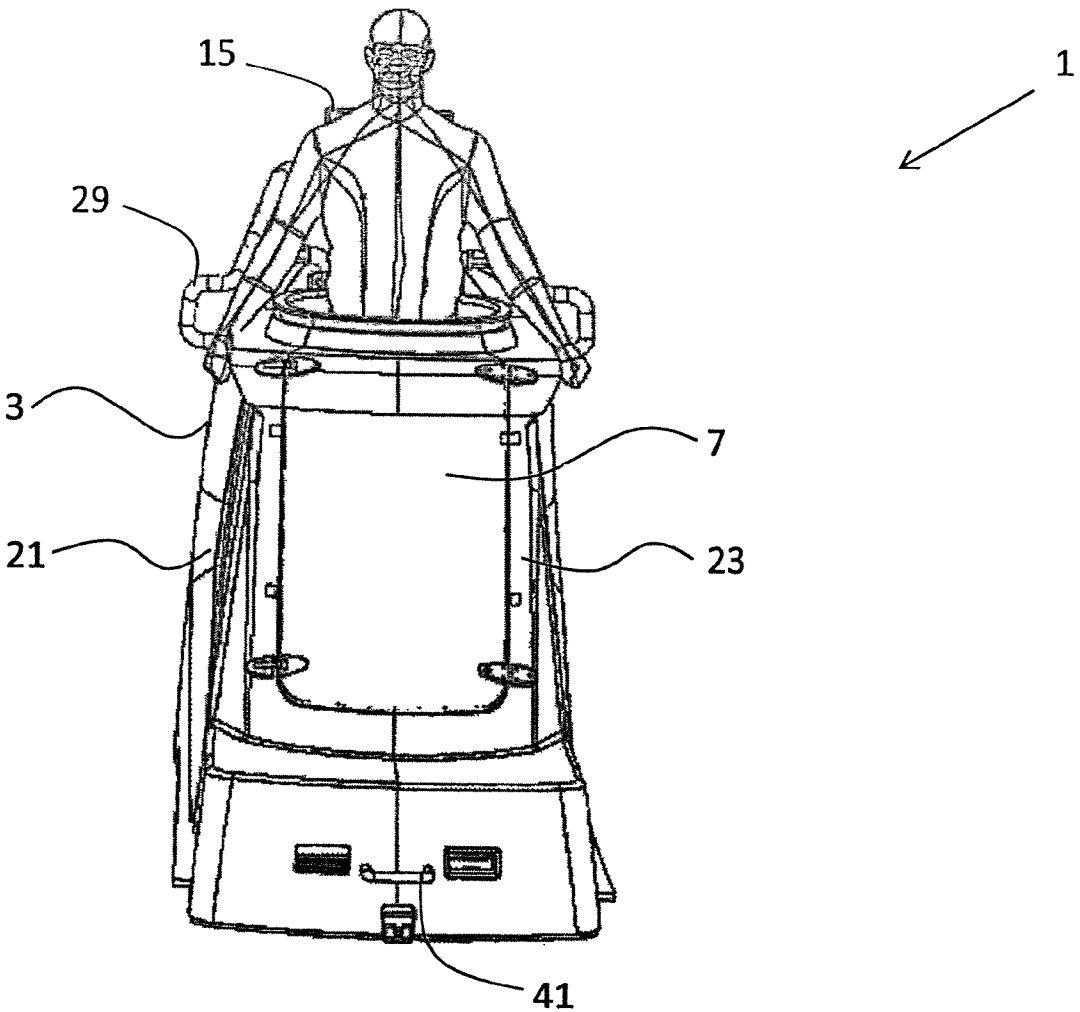
FIG. 2 is a rear view of the exercise device shown in FIG. 1.
Figure 3:
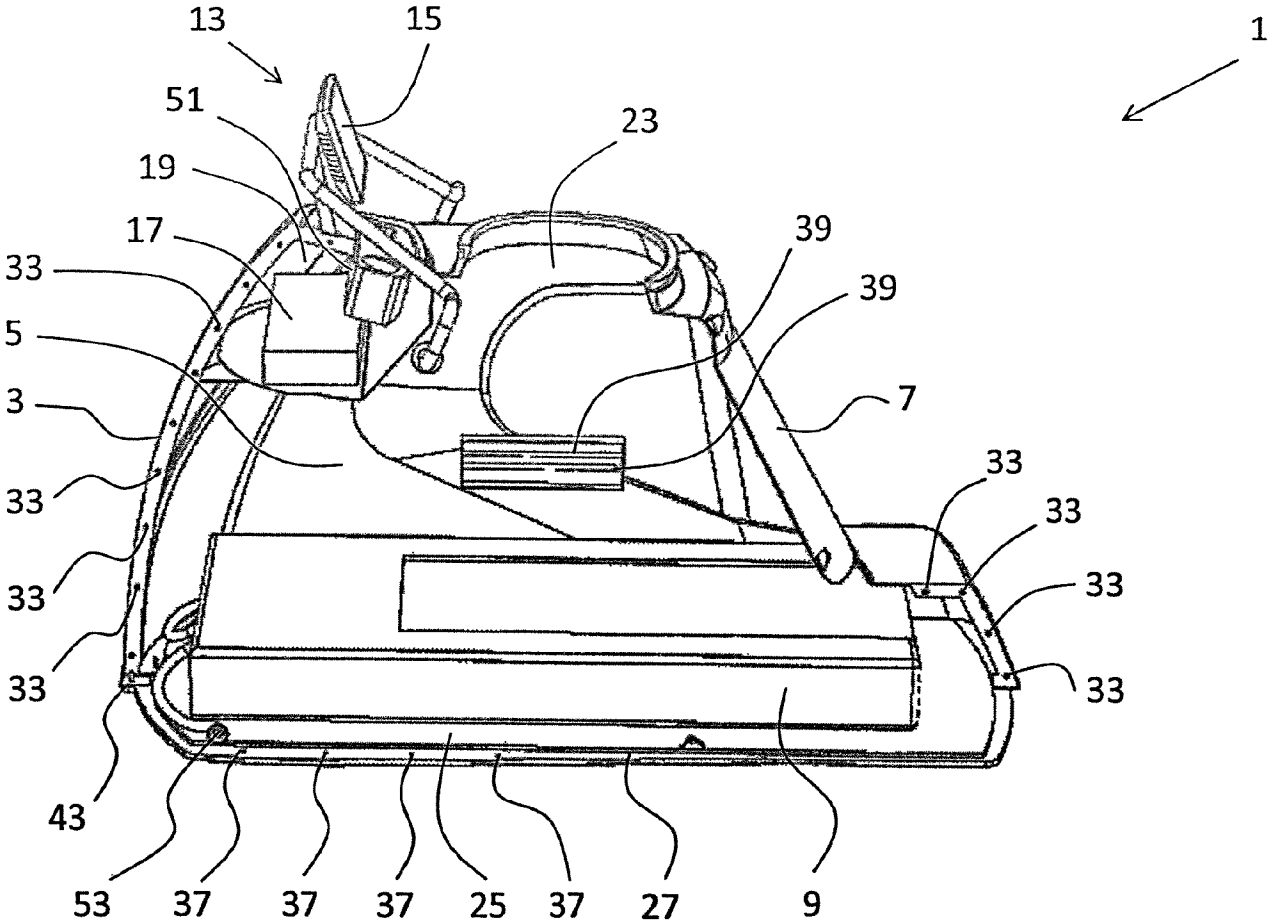
FIG. 3 is a left hand side perspective view of the exercise device with a casing panel removed.
Figure 4:
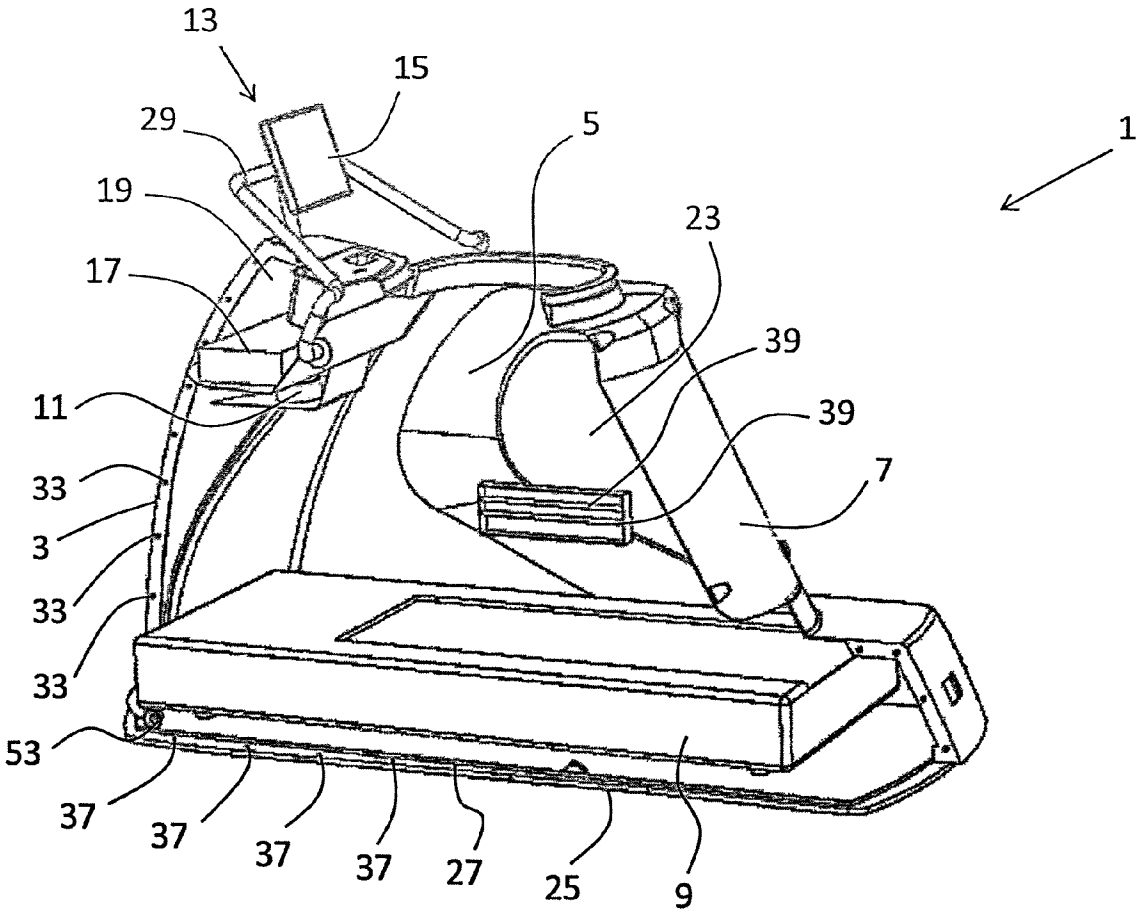
FIG. 4 is a rear perspective view of the exercise device shown in FIG. 3.
Figure 5:
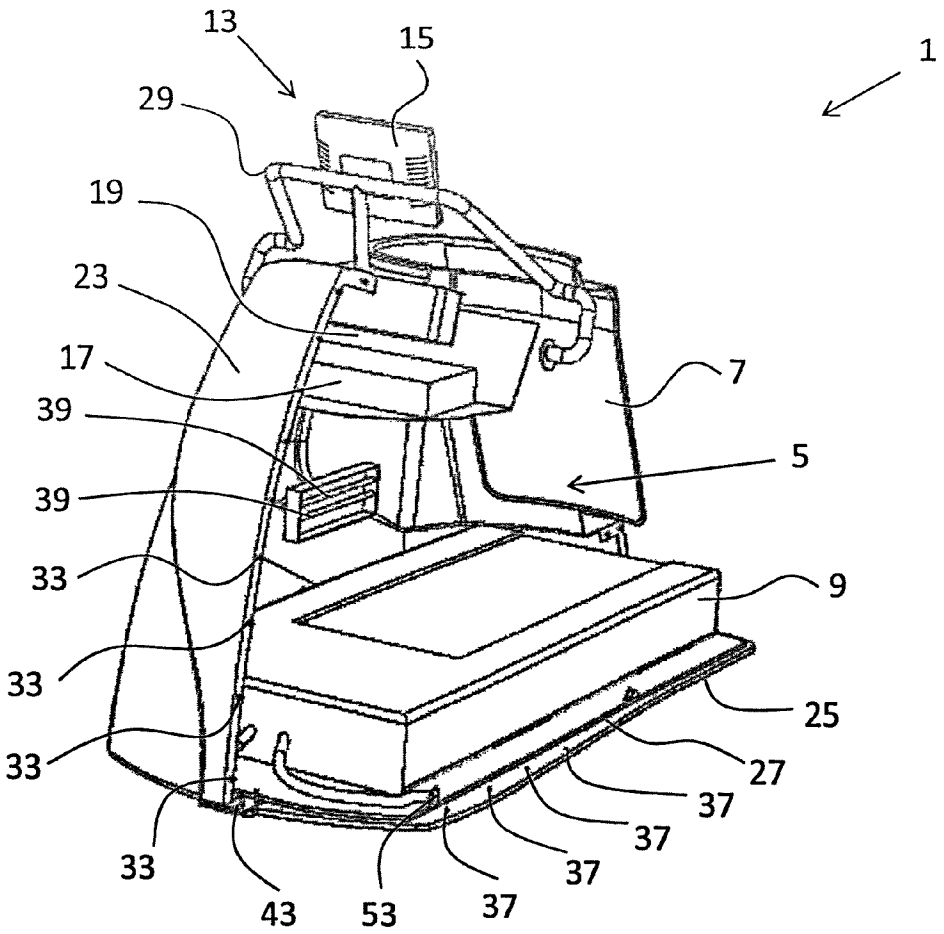
FIG. 5 is a front perspective view of the exercise device shown in FIG. 3.
Figure 6:
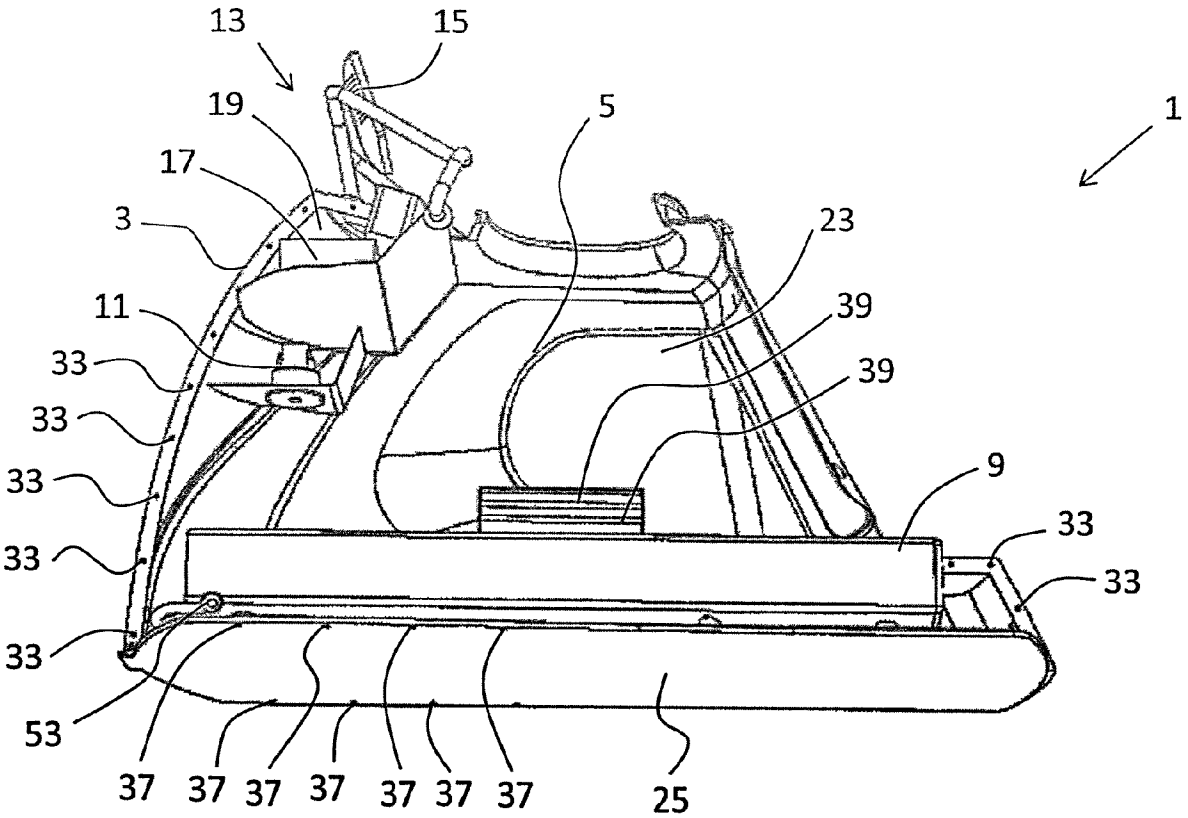
FIG. 6 is a side perspective view shown from below of the exercise device shown in FIG. 3.
Figure 7:
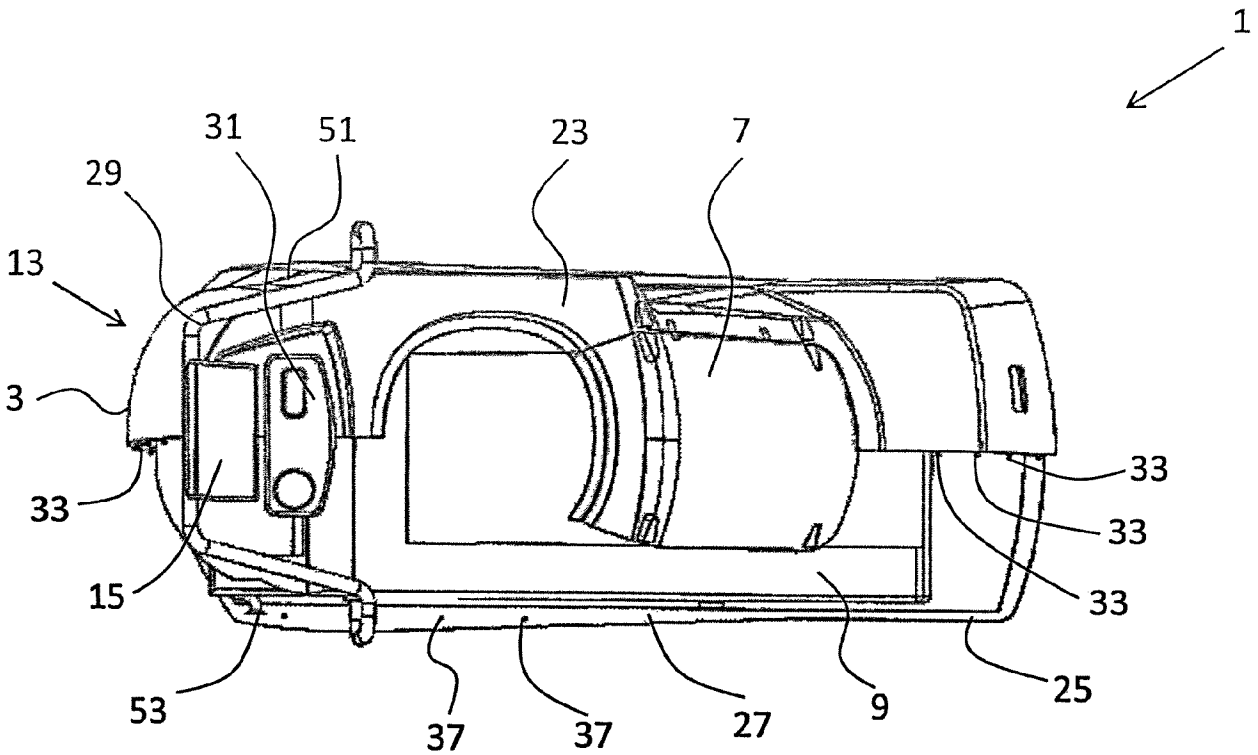
FIG. 7 is a top plan view of the exercise device shown in FIG. 3.
Figure 8:
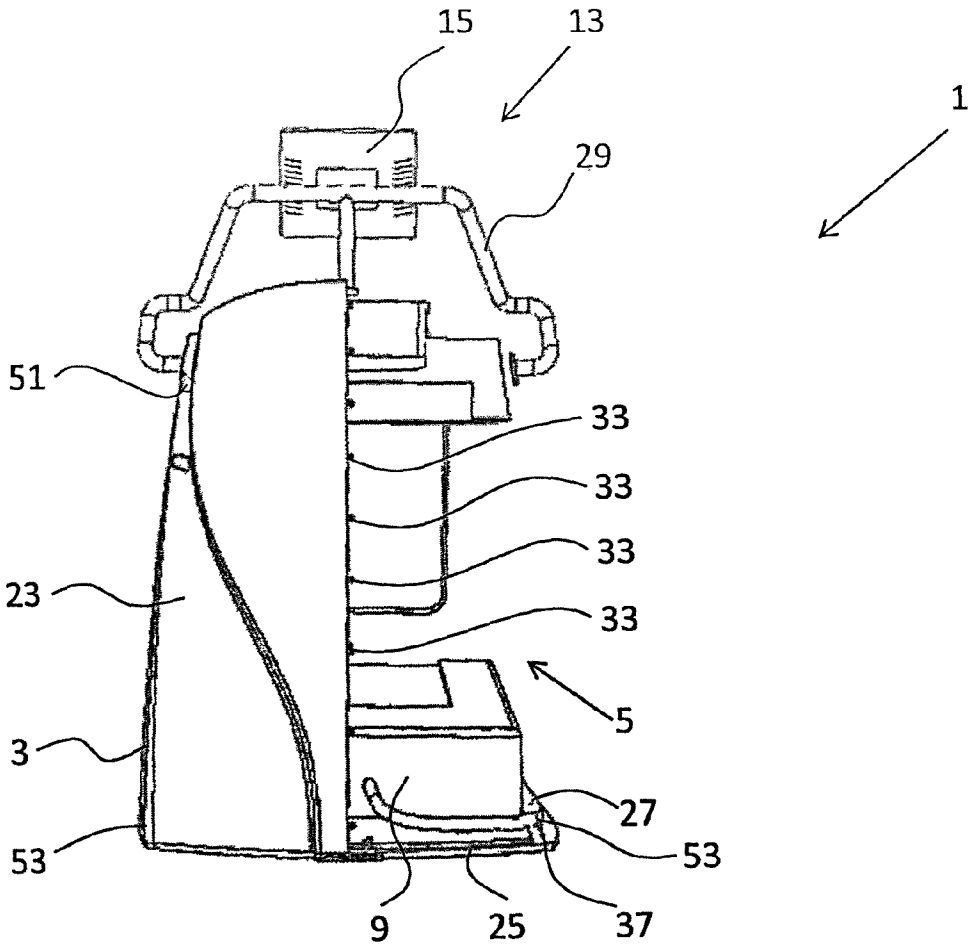
FIG. 8 is front view of the exercise device shown in FIG. 3.
Figure 9:
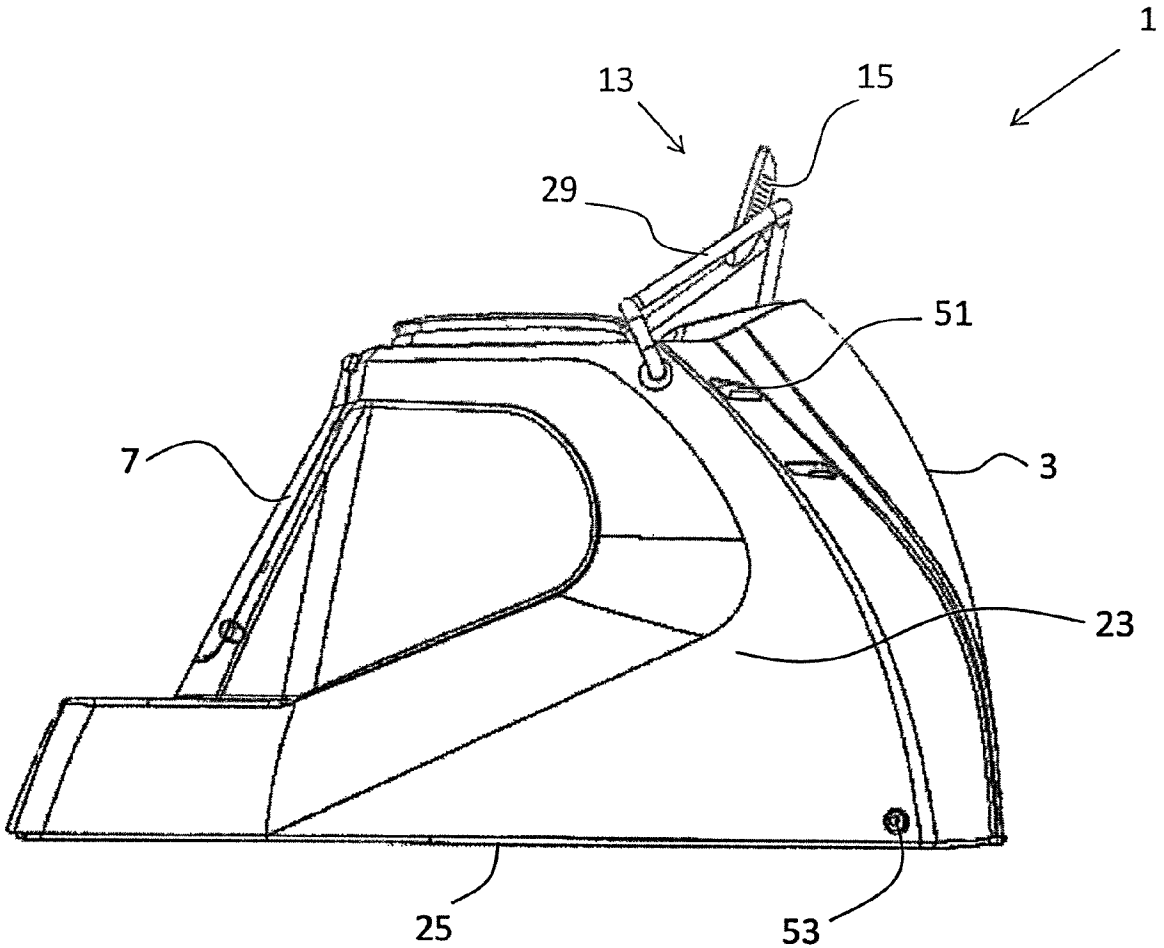
FIG. 9 is a right hand side view of the exercise device shown in FIG. 3.
Figure 10:
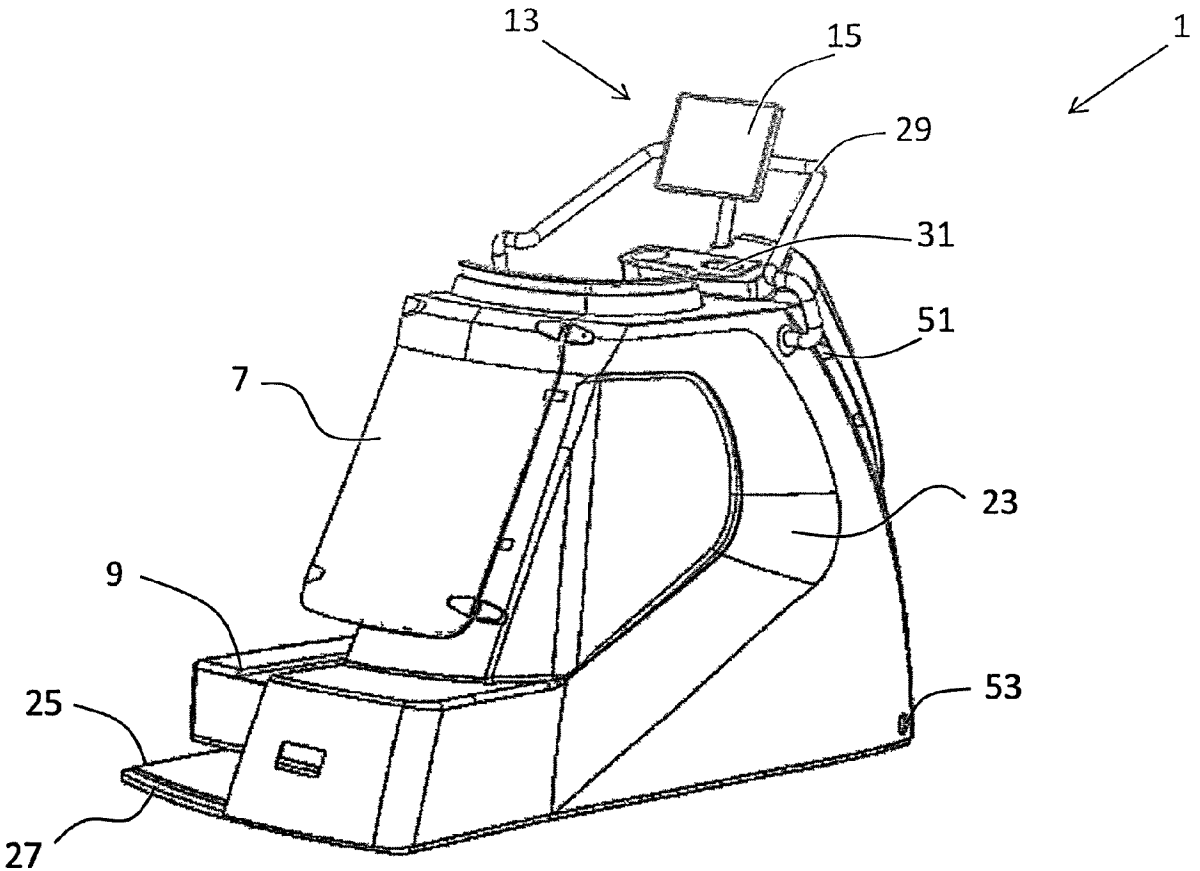
FIG. 10 is rear perspective view of the exercise device shown in FIG. 3.
Figure 18:
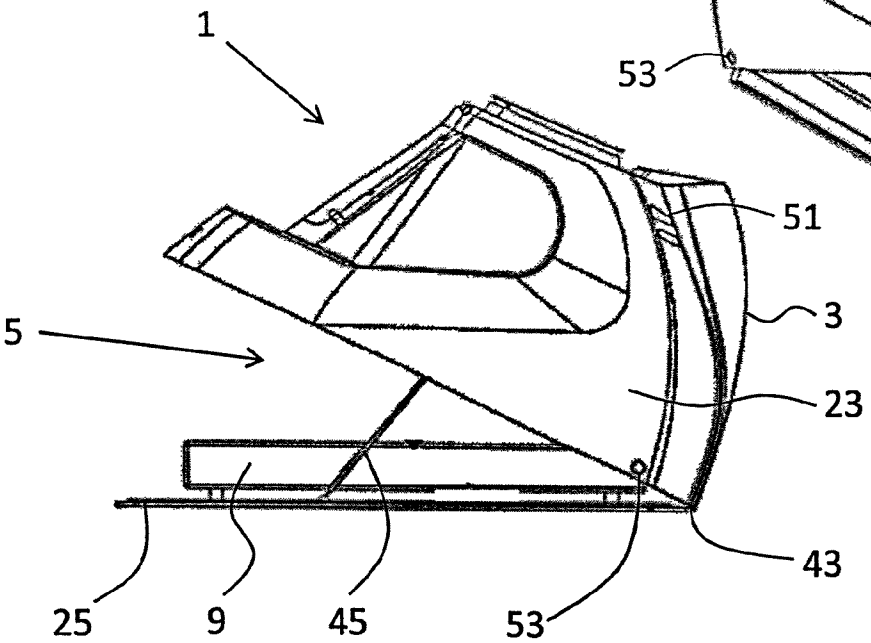
FIG. 18 is a side view of the exercise device shown in FIG. 15.

Referring now to FIGS. 15 to 18 inclusive, there is shown a plurality of views of the casing 3 pivoting about the base plate 25. The casing 3 is connected to the base plate 25 by way of a hinge joint 43. The hinge joint 43 allows the casing 3 to pivot about the hinge joint to and from a raised position free of the base plate 27 (FIGS. 17, 18) and a lowered position in abutment with the base plate 27 (FIGS. 1, 2). A gas strut 45 is provided, as shown in FIG. 18, to allow the casing 3 to be temporarily held in a raised position free of the base plate 27. This arrangement will allow simple access to the interior of the exercise device 1 which will facilitate access to the electronics panels if and when maintenance is required.

Figure 14:
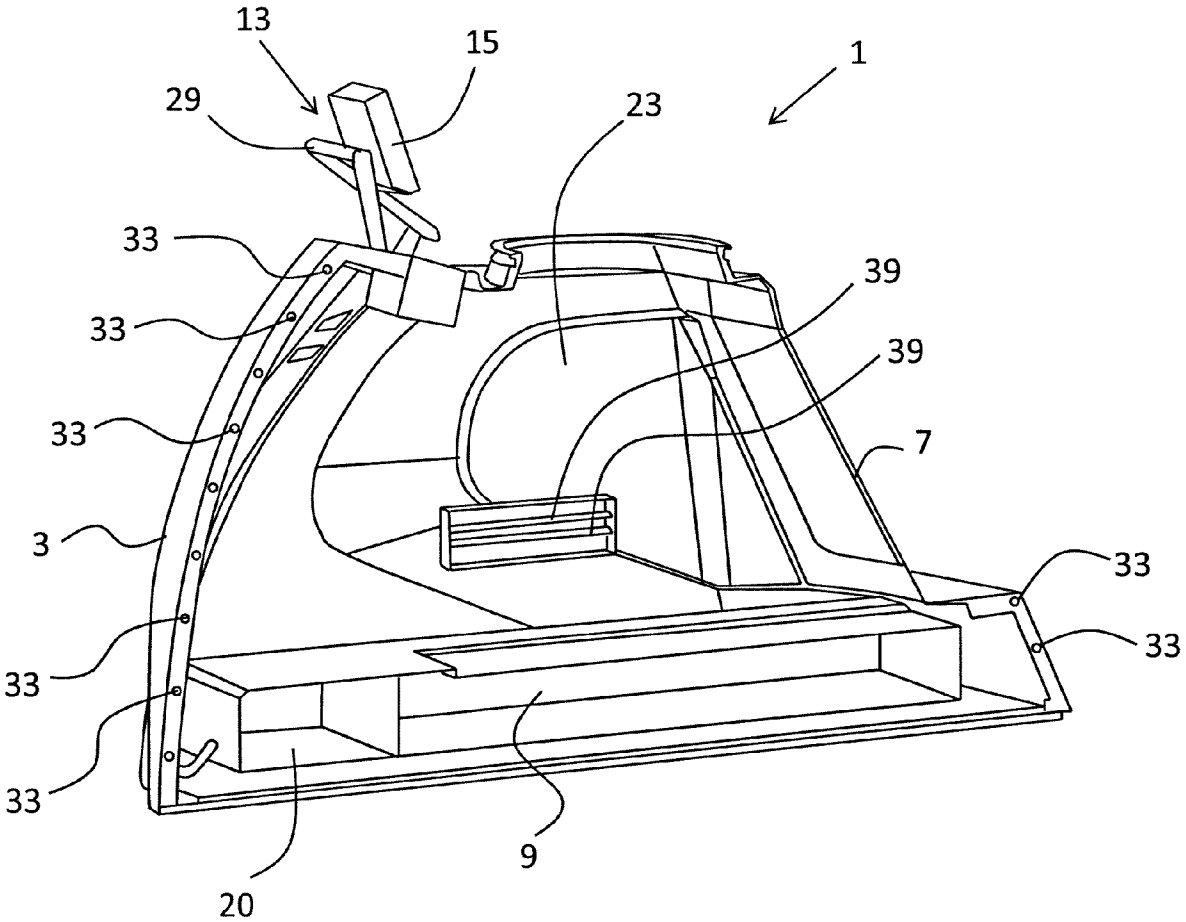
FIG. 14 is a view similar to FIG. 3 but showing the casing of the exercise unit in cross-section.
Figure 16:
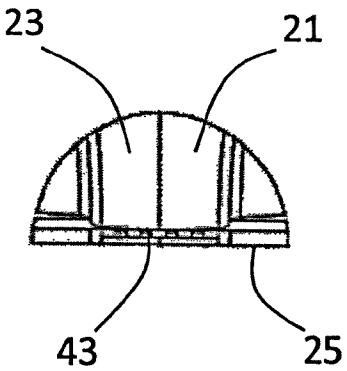
FIG. 16 is an enlarged view of the circled portion marked "A" in FIG. 15.
Figure 15:
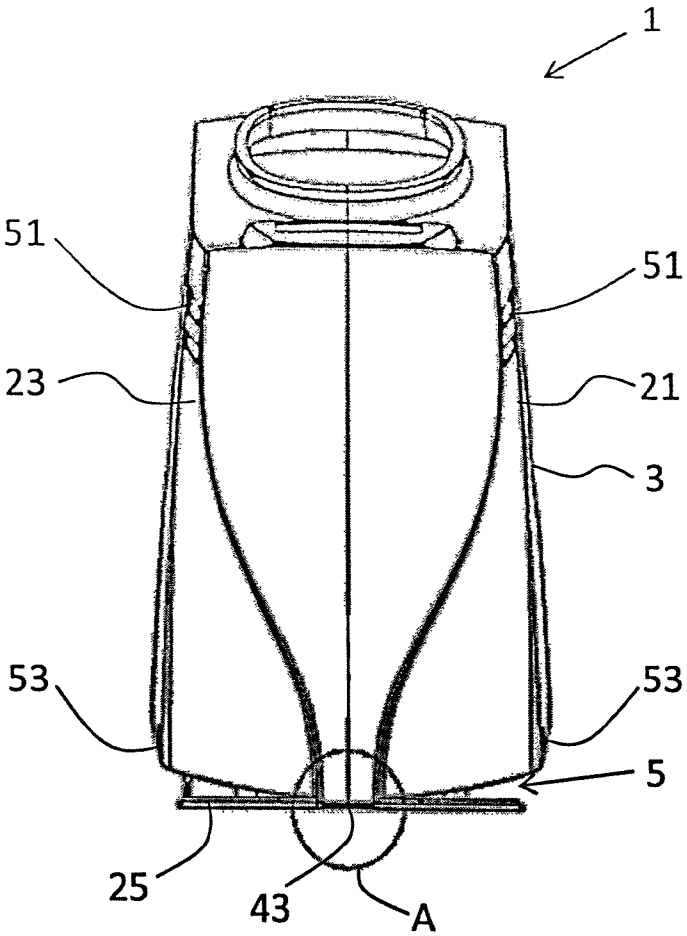
FIG. 15 is a front view of the casing with the control equipment removed for clarity showing the casing pivoted about a hinge on the base plate.
Figure 17:
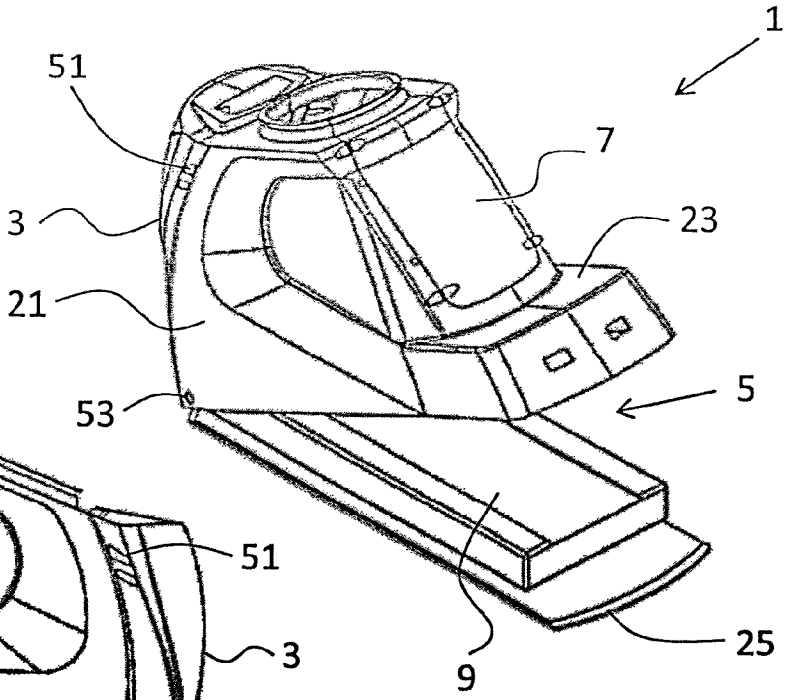
FIG. 17 is a rear perspective view of the exercise device shown in FIG. 15.

Referring now again specifically to FIGS. 3 to 6 inclusive and FIG. 14, there is shown the arrangement for keeping the first electronics panel cooled and the arrangement for keeping the second electronics panel (not shown) cooled. The first electronics panel 17 is mounted in the enclosure 19 and there is provided a vent hole 51 in the casing 3. The vent hole 51 is in communication with the interior of the enclosure 19 and the exterior of the casing 3. The enclosure is isolated from the rest of the interior of the casing 3. The ventilation arrangement further comprises a fan (not shown) for circulating ambient temperature air from external the casing over the electronics panel and exhausting that air from the enclosure 19 once it has passed over the electronics panel 17. In other words, there is provided a steady flow of ambient temperature air over the electronics panel by the fan drawing air in through the vent hole 51 and expelling it once again out through the vent hole.

The second electronics panel (not shown) is mounted in the second enclosure 20 and there is provided a vent hole 53 in the casing 3. The vent hole 53 is in communication with the interior of the enclosure 19 and the exterior of the casing 3. The enclosure 20 is formed integrally with the exercise unit 9 and is isolated from the rest of the interior of the casing 3. The second ventilation arrangement further comprises a fan (not shown) for circulating ambient temperature air from external the casing 3 over the second electronics panel and exhausting that air from the second enclosure 20 once it has passed over the second electronics panel. In other words, there is provided a steady flow of ambient temperature air over the second electronics panel by the fan drawing air in through the vent hole 53 and expelling it once again out through the vent hole 53. A motor (not shown) of the exercise device 9 can also be mounted internal the enclosure 20 and this will help cool the motor and reduce the temperature in the chamber 5.

Figure 19:
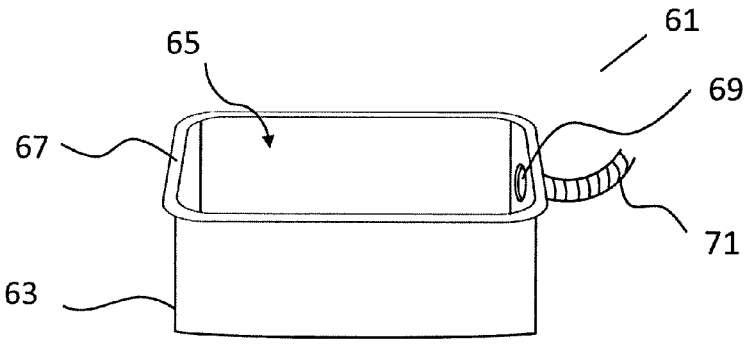
FIG. 19 is a diagrammatic representation of one embodiment of a dedicated enclosure for use in the exercise device according to the invention.
Figure 20:
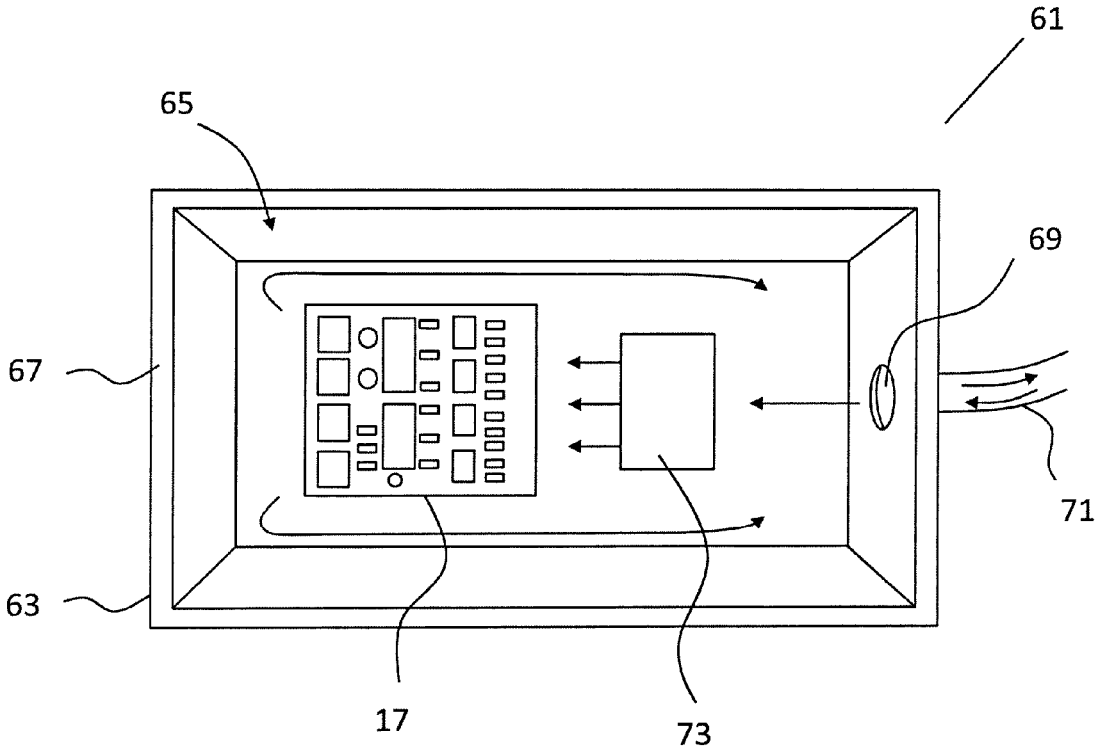
FIG. 20 is a plan view of the dedicated enclosure demonstrating the passage of ambient air in the dedicated enclosure.

Referring to FIGS. 19 and 20, there is shown a diagrammatic representation of an alternative embodiment of a dedicated enclosure, indicated generally by the reference numeral 61, for use in the exercise device according to the invention. The dedicated enclosure comprises a basin-shaped container 63 having an open mouth 65 and a circumferentially extending lip 67 surrounding the open mouth for sealable engagement with the casing (not shown). The enclosure 61 comprises a throughhole 69 for engagement with a conduit 71. In this case, the conduit consists of a length of flexible hose pipe connected at one end to the throughhole. The other end of the conduit 71 is connected to the vent hole 51 in the casing 3 (neither of which are shown in this drawing). The conduit 71 therefore provides an air passageway from the interior of the enclosure 61 to the atmosphere external the casing. Referring specifically to FIG. 20, there is shown an electronics panel 17 and a fan 73. The fan 73 draws ambient temperature air inwards from the atmosphere outside the casing through the vent hole 51 (not shown), draws the air along the conduit 71 through the throughhole 69 and into the enclosure 61. The air is then circulated over the electronics panel 17, cooling the electronics panel in the process, before the air is expelled out of the enclosure 61, through the throughhole 69, along the conduit 71 and out through the vent hole 51.

Figure 21:
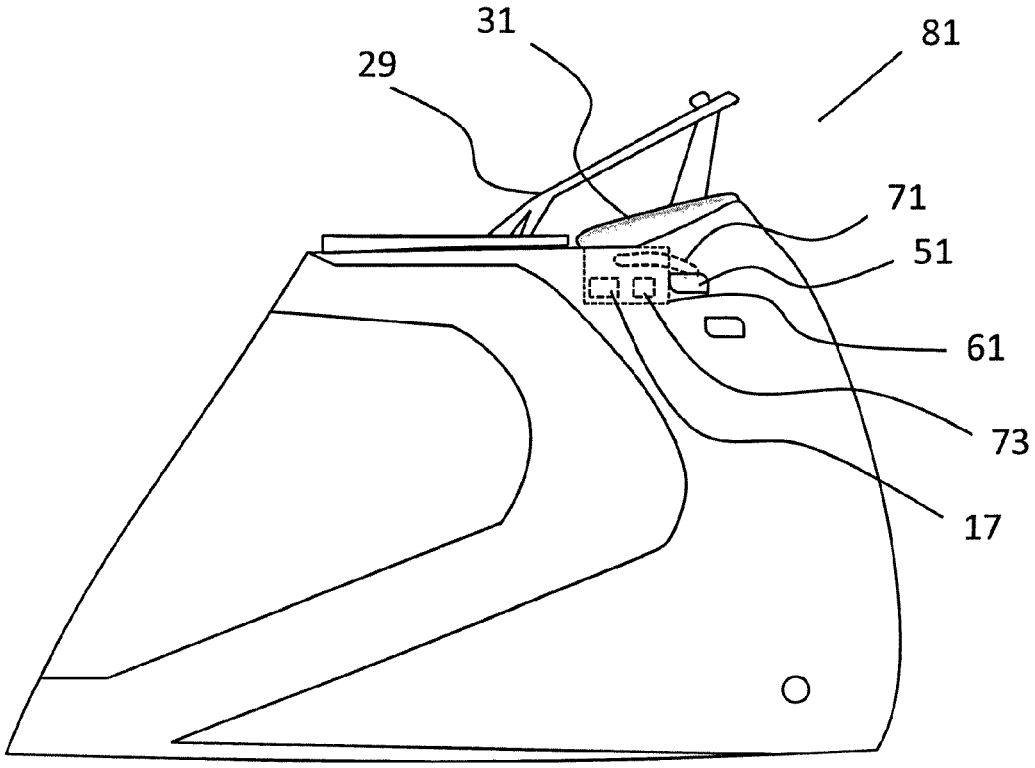
FIG. 21 is a side view of an alternative construction of exercise device with the dedicated enclosure shown in ghost outline.

Referring to FIG. 21, there is shown a side view of an alternative construction of exercise device, indicated generally by the reference numeral 81, where like parts have been given the same reference numeral as before, with the dedicated enclosure 61, conduit 71, fan 73 and electronics panel 17 shown in ghost outline. It can be seen that the enclosure is mounted towards the front and the top of the chamber 5 in the casing 3. The enclosure is positioned below the drinks tray 31. In this position, the electronics panel 17 can be accessed by removing the drinks tray 31 and accessing the electronics panel through the open mouth 63 of the enclosure 61. The circumferentially extending lip (not shown) is used to form a tight seal with the casing so that there is no ingress of air into the negative pressure chamber 5 when the chamber is subjected to a negative pressure. Sealants, either temporary such as a rubber or a foam seal, or permanent such as silicon or glue can be used to provide the substantially air-tight seal between the circumferentially extending lip 67 and the interior or exterior of the casing, depending on how it is desired to mount the enclosure on the casing. The enclosure 61 can be held in place by glue or preferably by nuts and bolts or other releasable engagement means. The exercise device in the embodiment shown differs from previous implementations in that a step is not provided at the rear of the device, thereby reducing the footprint of the device. Furthermore, it can be seen that the control panel 15 is not shown but would normally be provided.

Figure 22:
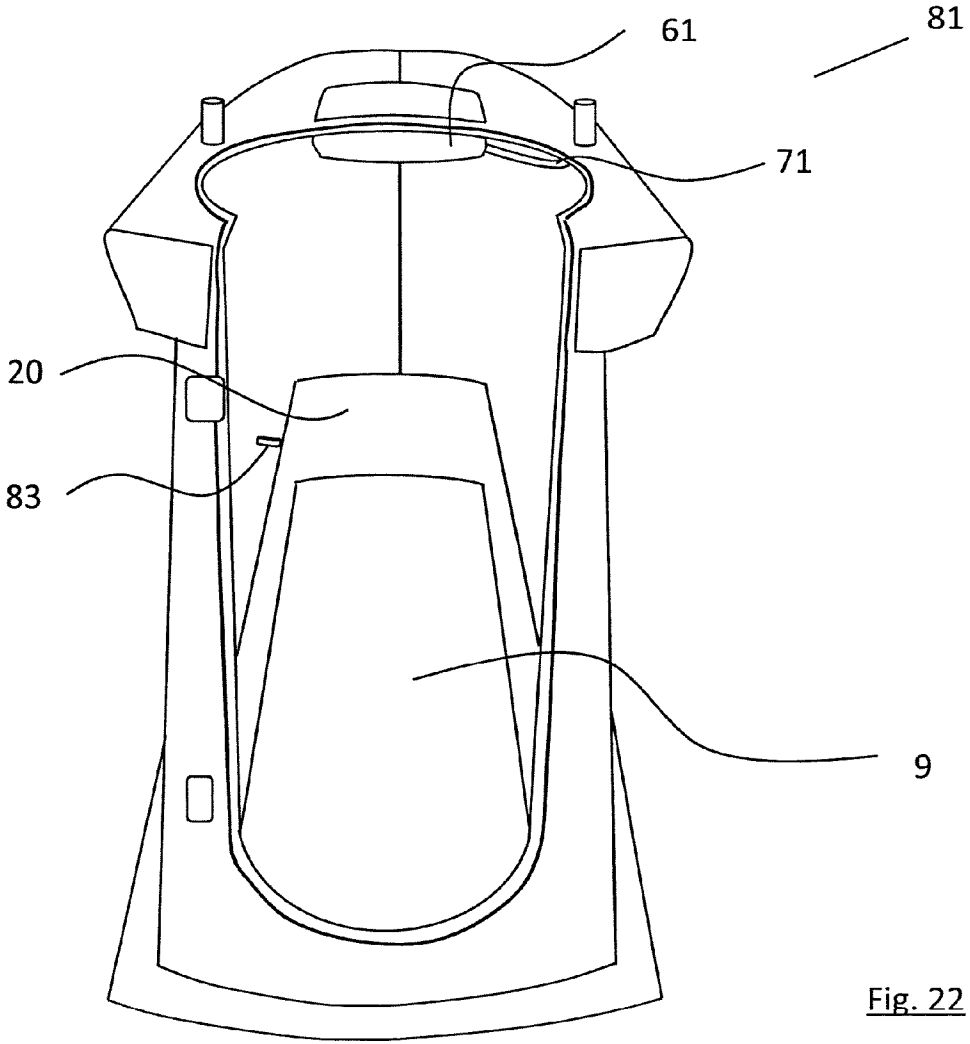
FIG. 22 is a rear view from above of a partially constructed exercise device similar to that shown in FIG. 21 illustrating the dedicated enclosure and the second dedicated enclosures positions internal the device.

Referring to FIG. 22, there is shown a rear view from above of a partially constructed exercise device 81 similar to that shown in FIG. 21 illustrating the positioning of the dedicated enclosure 61 and the second dedicated enclosure 20 internal the exercise device 81. The dedicated enclosure 61 is located at the top of the chamber towards the front of the chamber 5. The second dedicated enclosure 20 forms part of the exercise unit 9. A fan (not shown), is located inside the second enclosure 20 and a conduit 83, in this case a length of flexible hose pipe, is connected to the between a throughhole (not shown) in the second enclosure and the vent hole 53 (not shown). In this way, there is provided an air passageway between the ambient temperature air outside the casing and the interior of the second enclosure so that air may be circulated from outside the casing, in through the vent hole 53, along the conduit 83 and into the interior of the second enclosure 20. The air is circulated over the second electronics panel before being exhausted out through the throughhole in the second enclosure, along the conduit 83 and out through the vent hole 53.

It will be understood that various constructions and materials could be used for the casing in particular however it is envisaged that fiberglass or a plastics material would be particularly suitable for the casing. Furthermore, the precision of vacuum fusion moulding is seen as a particularly suitable manufacturing methodology to use as the tolerances can be kept to a very tight margin even for such a relatively large device.

In this specification the terms "comprise, comprises, comprised and comprising" and the terms "include, includes, included and including" are all deemed totally interchangeable and should be afforded the widest possible interpretation.

The invention is in no way limited to the embodiment hereinbefore described but may be varied in both construction and detail within the scope of the claims.

The invention claimed is:

1. An exercise device comprising a casing defining an exercise chamber having an opening to receive the torso of an individual during use of the exercise device, a door in the casing to provide access to and from the exercise chamber, an exercise unit located in the exercise chamber, a vacuum pump operable to create a negative pressure in the exercise chamber and control means for controlling the exercise unit and the vacuum pump, the control means comprising an electronics panel which is associated with the vacuum pump and is mounted internal the chamber, in which the electronics panel is mounted in a separate dedicated enclosure internal the chamber, the interior of the dedicated enclosure is isolated from the negative pressure conditions and atmosphere in the remainder of the chamber, and in which there is further provided a ventilation arrangement for the dedicated enclosure and the electronics panel to cool the electronics panel during operation of the exercise device, the ventilation arrangement comprising a fluid passageway between the interior of the dedicated enclosure and the atmosphere external the casing, the fluid passageway comprising at least a vent hole in the casing in communication with the atmosphere external the casing for allowing entry of ambient temperature air inwards from external the casing through the vent hole and along the fluid passageway to circulate across the electronics panel in the dedicated enclosure before being exhausted back out of the dedicated enclosure through the vent hole.

2. The exercise device as claimed in claim 1 in which the ventilation arrangement further comprises a fan mounted in the dedicated enclosure for drawing ambient temperature air inwards from external the casing through the vent hole and along the fluid passageway and thereafter circulating the ambient air across the electronics panel in the dedicated enclosure before exhausting the ambient air back out of the dedicated enclosure through the vent hole.

3. The exercise device as claimed in claim 1 in which the fluid passageway further comprises a length of conduit, one end of which is in communication with the interior of the dedicated enclosure and the other end of which is in communication with the vent hole.

4. The exercise device as claimed in claim 1 in which the enclosure is located adjacent the front of the chamber.

5. The exercise device as claimed in claim 1 in which the enclosure is located adjacent the top of the chamber.

6. The exercise device as claimed in claim 1 in which the dedicated enclosure is a basin shaped enclosure having an open mouth and a circumferentially extending lip surrounding the open mouth for sealable engagement with the casing.

7. The exercise device as claimed in claim 6 in which the dedicated enclosure is constructed from one of a plastics and a fiberglass material.

8. The exercise device as claimed in claim 1 in which the control means comprises a second electronics panel which is associated with the exercise unit and is mounted internal the casing, in which the second electronics panel is mounted in a second separate dedicated enclosure internal the casing, the interior of the second enclosure is isolated from the negative pressure conditions in the remainder of the chamber and in which there is further provided a second ventilation arrangement for the second enclosure and the second electronics panel to cool the second electronics panel during operation of the exercise device, the second ventilation arrangement comprising a second fluid passageway between the interior of the second enclosure and the atmosphere external the casing, the second fluid passageway comprising at least a second vent hole in the casing in communication with the atmosphere external the casing, the second ventilation arrangement further comprising a fan mounted in the second enclosure for drawing ambient temperature air inwards from external the casing through the second vent hole and along the second fluid passageway and thereafter circulating the ambient air across the second electronics panel in the second enclosure before exhausting the ambient air back out of the second enclosure through the second vent hole.

9. The exercise device as claimed in claim 8 in which the second fluid passageway further comprises a second length of conduit, one end of which is in communication with the interior of the second enclosure and the other end of which is in communication with the second vent hole.

10. The exercise device as claimed in claim 8 in which the second enclosure is located adjacent the front of the chamber.

11. The exercise device as claimed in claim 8 in which the second enclosure is located adjacent the bottom of the chamber.

12. The exercise device as claimed in claim 11 in which the second enclosure is formed as part of the exercise unit.

13. The exercise device as claimed in claim 12 in which a motor of the exercise unit is also mounted in the second enclosure.

14. The exercise device as claimed in claim 1 in which the exercise unit is mounted on a base plate and in which the casing is hingedly mounted about the base plate and pivotable to and from a lowered position sealably engaging the base plate and a raised position inclined relative to and substantially free of the base plate.

15. The exercise device as claimed in claim 14 in which there is further provided a strut internal the casing to releasably maintain the casing in a raised position.

16. The exercise device as claimed in claim 14 in which the casing is hingedly mounted about a hinge joint located adjacent the forwardmost point on the base plate.

17. The exercise device as claimed in claim 2 in which the fluid passageway further comprises a length of conduit, one end of which is in communication with the interior of the dedicated enclosure and the other end of which is in communication with the vent hole.

18. The exercise device as claimed in claim 4 in which the enclosure is located adjacent the top of the chamber.

19. The exercise device as claimed in claim 10 in which the second enclosure is located adjacent the bottom of the chamber.

20. The exercise device as claimed in claim 19 in which the second enclosure is formed as part of the exercise unit.

* * * * *